United States Patent [19]

Stuckmann et al.

[11] 4,073,153

[45] Feb. 14, 1978

[54] DRIVE SHIELDS FOR TUNNELLING

[75] Inventors: Dieter Stuckmann, Selm; Hans Jütte, Dortmund-Brechten, both of Germany

[73] Assignee: Gewerkschaft Eisenhutte Westfalia, Lunen, Germany

[21] Appl. No.: 733,887

[22] Filed: Oct. 19, 1976

[30] Foreign Application Priority Data

Oct. 21, 1976 Germany ..... 2547021

[51] Int. Cl.[2] ..... E21D 19/00

[52] U.S. Cl. ..... 61/85

[58] Field of Search ..... 61/85, 41 A, 84; 299/31

[56] References Cited

U.S. PATENT DOCUMENTS 3,640,077 2/1972 Watson et al. ..... 61/85

3,800,549 4/1974 Lobbe ..... 61/85

3,903,707 9/1975 Folk ..... 61/85

*Primary Examiner*—Jacob Shapiro

*Attorney, Agent, or Firm*—Thompson, Birch, Gauthier & Samuels

[57] ABSTRACT

A drive shield for use in a tunnel driving operation has an inner frame with hollow rings interconnected in a rigid fashion. A plurality of sharp-ended drive members combine to form a cylindrical shell contacting the tunnel wall. Rams serve to advance the drive members in the advancing direction either individually or in groups and to draw up the inner frame. Support devices of circuate shape form a second shell inside the drive members and support and guide the latter. Piston and cylinder units are interposed between the rings and the support devices and serve to displace the latter radially so that selected members can be forced against the tunnel wall with a greater or lesser pressure.

7 Claims, 3 Drawing Figures

DRIVE SHIELDS FOR TUNNELLING

BACKGROUND TO THE INVENTION

The present invention relates to a drive shield for use in driving or excavating tunnels, adits, galleries and similar cavities and hereinafter referred to as a tunnel or tunnels for convenience.

Known forms of drive shields are composed of a series of sharp-ended plank-like drive members arranged side-by-side in contact with the tunnel wall and supported for longitudinal displacement in the advancing direction by a frame. The pressure exerted on the drive members by the tunnel wall usually varies around the wall and over zones along the tunnel. It is known to sub-divide a drive shield into two parts each part being composed of at least one expandable ring and a group of drive members carried thereby. Such a construction is described in German specifications 2,314,703 and 2,144,862. The drive members of the parts are interspersed to provide the usual cylindrical shell contacting the tunnel wall and either shield part can be firmly braced against the wall by expanding the appropriate ring. Rams serve to alternately shift one drive shield part in relation to the other. With such a construction it is not possible to shift individual drive members nor is it possible to brace selected members against part of the tunnel wall with increased force relative to the other members.

A general object of the present invention is to provide an improved drive shield.

SUMMARY OF THE INVENTION

According to one aspect of the invention there is provided a drive shield for use in tunnel driving operations; said drive shield comprising a plurality of drive members arranged side-by-side and adapted for individual displacement in the advancing direction relative to an inner frame structure and a supporting and bracing means which serves to directly carry the drive members, wherein the supporting and bracing means is movable along with the inner frame structure in the advancing direction and is capable of displacing selected drive members in an outward direction generally perpendicular to the advancing direction in relation to the inner frame structure.

In another aspect the invention provides a drive shield for use in tunnel driving, said drive shield comprising a plurality of drive members arranged side-by-side to form a shell for contacting the wall of the tunnel, a frame for supporting the drive members and means for effecting relative displacement between the drive members and the frame in the tunnel drive direction, wherein the frame has a plurality of devices directly supporting the drive members and a rigid inner frame structure and means is provided between the inner frame structure and the support devices for displacing the devices radially inwardly or outwardly relative to the inner frame structure.

A drive shield made in accordance with the invention can provide a particularly robust and yet simple construction whereby selected drive members, already individually displaceable in the advancing direction, can be forced against the tunnel wall without disturbing the inner frame structure or the remaining drive members.

In a preferred form the support devices are of arcuate form and combined, as segments of a circle, to produce a shell of cylindrical configuration lying within the drive members. Each device may support several drive members. The inner frame structure may then lie within the shell defined by the support devices and this structure may be composed of two ring-like components spaced apart axially along the tunnel an rigidly interconnected by means arranged to leave the interior unobstructed.

The support devices may each be constructed as a lattice-like frame with longitudinal elements and cross-pieces and the longitudinal elements of the device preferably locate in radial slots in the ring component of the inner frame structure.

The means for displacing the devices may be in the form of hydraulic piston and cylinder units with a number of units allocated to each support device. It is desirable to then make the ring components at least partly hollow to house the hydraulic units. This provides for safety and ensures a compact construction.

The relative displacement between the frame and the drive members would normally be effected by hydraulic rams as is known per se only here the ram can be supported on the support devices.

The hydraulic units used to displace the support devices radially are preferably provided with pressure-relief valves for safety so that retraction of any device will occur automatically if the counter pressure exerted by the associated part of the tunnel wall rises too high. It is also useful to provide a hydraulic control circuit to control the fluid flow to the units as discussed in more detail hereinafter.

The invention also provides in a preferred form a drive shield for tunnel driving comprising two hollow components spaced apart along the tunnel drive direction and interconnected to form a rigid frame structure, a plurality of arcuate support devices combining to form a first cylindrical shell, hydraulic piston and cylinder units interposed between the frame structure and the support devices and operable to displace the individual devices perpendicularly to the tunnel drive direction, the frame structure and the support devices being movable as a whole in the tunnel driving direction, a plurality of drive members arranged side-by-side in parallel relationship to form a second cylindrical shell contacting the tunnel wall and radially externally of the first shell, the drive members being directly supported by the support devices for individual displacement in the tunnel driving direction and rams operable to relatively displace the drive members on the one hand and the frame structure and the support devices on the other hand in the tunnel driving direction.

The invention may be understood more readily, and various other features of the invention may become more apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
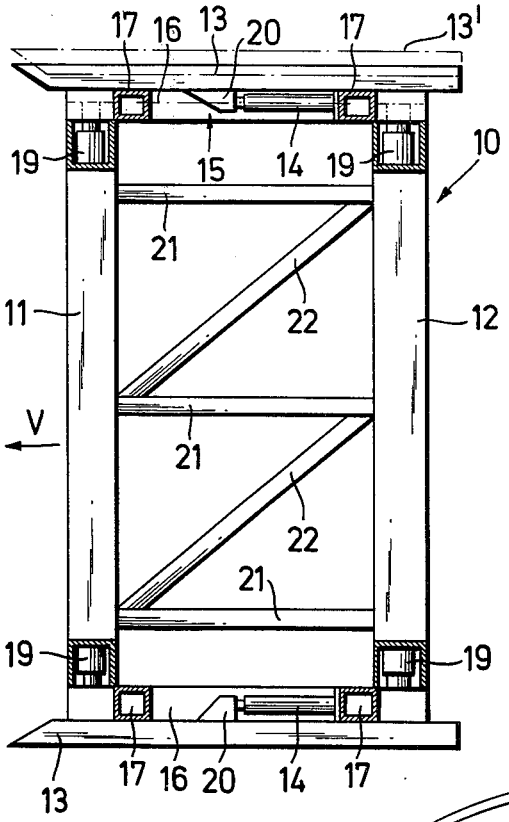
FIG. 1 is a schematic part-sectional side view of a drive shield made in accordance with the invention.
Figure 2:
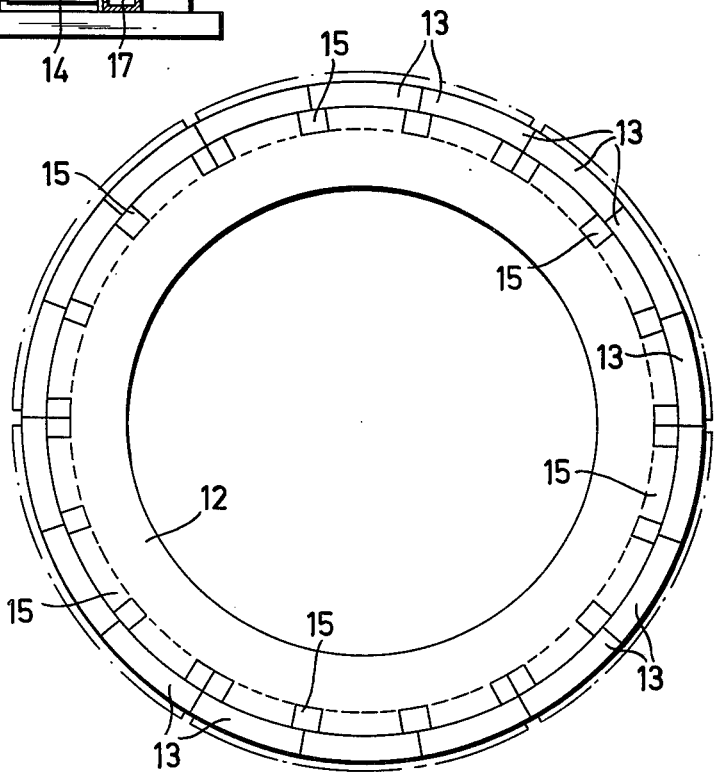
FIG. 2 is a rear end view of the shield represented in FIG. 1.

As shown in the drawings, a drive shield made in accordance with the invention has a multi-part main frame 10 with two ring-like frame components 11, 12 spaced apart axially and interconnected by rigid connecting pieces 21, 22 to form a rigid inner frame structure while leaving the interior of the frame unobstructed. The individual frame components 11, 12 are hollow with a trough or channel shaped cross-section. The frame 10 is itself surmounted by an array of elongate drive members 13 formed with cutting edges at their forward ends. The members 13 extend side-by-side in parallel relationship and collectively form a cylindrical shell or casing contacting the tunnel wall.

In known manner the drive members 13 are all individually displaceable in their longitudinal sense relative to the frame 10. During use, the members 13 are thrust forward in the advancing direction, arrow V FIG. 1, either individually or in groups to penetrate the working face. The debris or spoil is removed from the face by known means. When all the members 13 have all been fully advanced the frame 10 is shifted or drawn up on the advancing direction V. Relative movement between the members 13 and the frame 10 is effected by double-acting hydraulic rams 14.

In accordance with the invention the drive members 13 are carried, in this case supported and guided, by support and bracing means which may be thought of as forming part of the main frame 10 but which is displaceable relative to the inner rigid frame structure 11, 12, 21, 22. In the illustrated construction, the support and bracing means is composed of support devices 15 located between the rings 11, 12 and bracing devices 19. Although not actually depicted in the drawings the members 13 are preferably positively guided on the devices 15 for their longitudinal displacement in direction V, for example by tongue and groove connections of T-shaped cross-section. The devices 15 themselves are each of arcuate form and combine to provide an inner cylindrical shell of the frame 10 disposed within the outer shell composed of the members 13. Each device 15 is a rigid structure composed of longitudinal elements 16 and cross pieces 17 interconnecting the elements 16. Some six devices 15 are provided in all with each device 15 supporting a group of three of the drive members 13.

Figure 3:
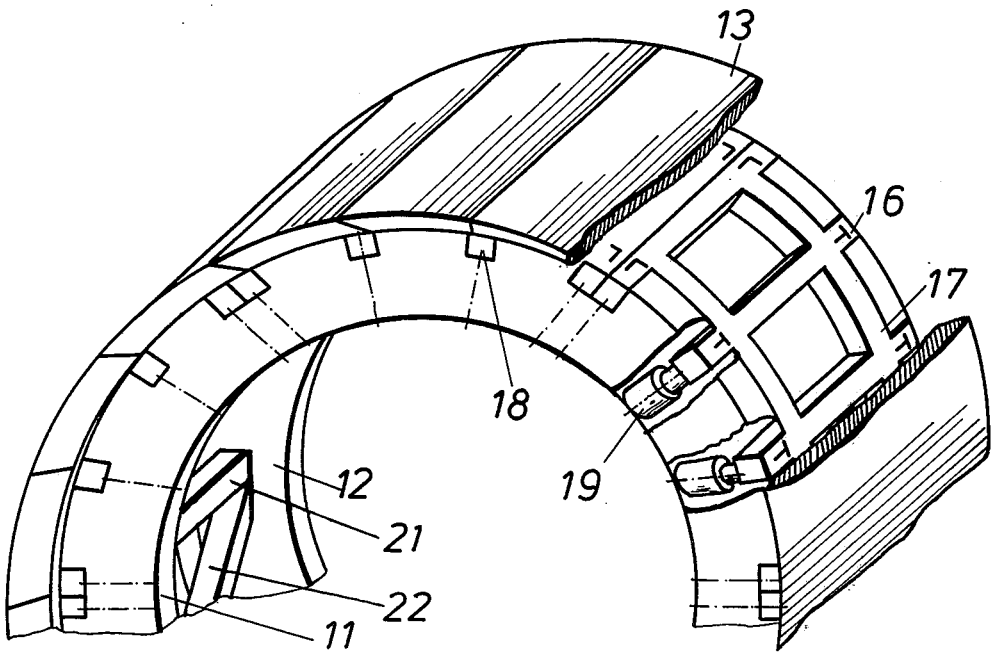
FIG. 3 is a perspective view of part of the shield represented in FIGS. 1 and 2 with some of the drive members broken away for clarity.

The ring components 11, 12 of the frame 10 are provided with radial slots 18 which locate and receive the end portions of the elements 16 of the devices 15 for radial movement perpendicular to the advancing direction V. This radialy movement of the devices 15 is effected by the bracing devices 19 which are here embodies by hydraulic piston and cylinder units. These units 19 are housed at least partially in the ring components 11, 12 as shown in FIGS. 1 and 3. The cylinders of the units 19 are connected to the respective components 11, 12 while their piston rods are connected to the elements 16 of the respective devices 15. Relative longitudinal axial displacement between the rings 11, 12 and the devices 15 is limited or resisted.

The rams 14 have their cylinders connected to the rear cross-piece 17 of the devices, as shown in FIG. 1, and the piston rods of the rams 14 are connected to the inner faces of the drive members 13 with the aid of shoes 20. It is however possible for the cylinders of the rams 14 to engage on the rear components 12 provided there is some angular mobility there between to cope with the radialy displacement of the devices 15. In the illustrated construction it is assumed that each drive member 13 has its own ram 14 allocated thereto although it is possible for one ram 14 to operate several members 13.

During operation, the members 13 are urged forwards in relation to the frame 10 by operating the relevant rams 14. If desired certain groups of the drive members 13 can be displaced outwardly from the shell provided by the members 13 as shown by the chain dotted line 13' in FIG. 1. In this way selected members 13 can be braced against the tunnel wall by operating the units 19 in question to resist any tendency of collapse or to prevent a rock burst. When all the members 13 have been advanced and the frame 10 is to be drawn up the rams 14 are all operated in unison in a reverse sense. Since essentially the devices 15 are only movable in a radial direction relative to the ring components 11, 12 and not longitudinally or axially in the direction V, the devices 15 and the ring components 11, 12 will move collectively in the direction V as the rams 14 are operated. During this operative cycle the members 13 act as an abutment for the shifting forces and resist displacement by virture of their frictional engagement with the tunnel wall. Under some conditions it may be desirable to operate the units 19 since then the members 13 can be more rigidly braced to resist any tendency to move when the frame 10 is being drawn up.

It is preferable to provide pressure-relief valves (not shown) for the units 19, each of which valves is set to operate to relieve the pressure chamber of the associated unit 19 should a pre-determined pressure be exceeded. A hydraulic control circuit can be provided to control the pressure applied to the units 19 and hence the pressure exerted on the tunnel wall by the members 13 can be maintained at some normal value.

Should the shield or part of the shell composed of the members 13 encounter a zone during the tunnel advance where the counter pressure exerted by the wall is reduced or increased within appropriate limits the units 19 can then automatically displace the devices 15 inwards or outwards to compensate for this change.

We claim:

1. A drive shield for use in tunnel driving operations, comprising: a plurality of laterally adjacent support devices carried on an inner frame structure, said support devices being fixed relative to said inner frame structure against movement in the tunnel driving direction; bracing means for individually displacing said support devices relative to said inner frame structure in a direction transverse to the tunnel driving direction; a plurality of drive members mounted on each of said support devices; and shifting means for individually reciprocating said drive members relative to their respective support devices in the tunnel driving direction.

2. A drive shield according to claim 1, wherein the support devices are each or arcuate form and combined to form a cylindrical shell within the drive members.

3. A drive shield according to claim 1, wherein the bracing means for displacing the support devices is composed of hydraulic piston and cylinder units.

4. A drive shield according to claim 1, wherein the inner frame structure is constructed from two axially-spaced ring components rigidly connected together.

5. A drive shield according to claim 4, wherein the bracing means for displacing the support devices is composed of hydraulic piston and cylinder units and wherein the ring components are at least partly hollow and the units are house at least partially within these ring components.

6. A drive shield according to claim 4, wherein the support devices are each of arcuate form and combine to form a cylindrical shell within the drive members and wherein the ring components have radial slots into which is received parts of the support devices.

7. A drive shield for tunnel driving comprising two hollow components spaced apart along the tunnel driving direction and interconnected to form a rigid frame structure, a plurality of arcuate support devices combining to form a first cylindrical shell, hydraulic piston and cylinder units interposed between the frame structure and the support devices and operable to displace the individual devices perpendicularly to the tunnel driving direction, the frame structure and the support devices being movable as a whole in the tunnel driving direction, a plurality of drive members arranged side-by-side in parallel relationship to form a second cylindrical shell contacting the tunnel wall and radially externally of the first shell, the drive members being directly supported by the support devices for individual displacement in the tunnel driving direction and rams operable to relatively displace the drive members on the one hand and the frame structure and the support devices on the other hand in the tunnel driving direction.

* * * * *